US006257426B1

(12) United States Patent
Masunaka et al.

(10) Patent No.: US 6,257,426 B1
(45) Date of Patent: Jul. 10, 2001

(54) SHELF ENGAGEMENT MECHANISM

(75) Inventors: Hideaki Masunaka, Tokyo; Seiji Kondo, Kanagawa, both of (JP)

(73) Assignee: Fujiei Inc., Aichi (JP)

( * ) Notice: Subject to any disclaimer, the term of this patent is extended or adjusted under 35 U.S.C. 154(b) by 0 days.

(21) Appl. No.: 09/400,415

(22) Filed: Sep. 21, 1999

(30) Foreign Application Priority Data

Sep. 25, 1998 (JP) ..... 10-007440

(51) Int. Cl.[7] ..... A47B 57/32

(52) U.S. Cl. ..... 211/187; 108/107; 108/147.12; 108/147.13

(58) Field of Search ..... 211/187, 181.1; 108/106, 107, 147.12, 147.13, 147.14, 147.15, 147.17, 147.18; 403/236, 256, 261, 374.1

(56) References Cited

U.S. PATENT DOCUMENTS 6,044,988 * 4/2000 Yang ..... 211/187
6,068,143 * 5/2000 Wang ..... 211/187
6,079,575 * 6/2000 Wang ..... 211/187

* cited by examiner

*Primary Examiner*—Daniel P. Stodola
*Assistant Examiner*—Erica B. Harris
(74) *Attorney, Agent, or Firm*—Jordan and Hamburg LLP

(57) ABSTRACT

A shelf engagement mechanism includes supports, taper sleeves, shelves, and rings. A plurality of annular engagement grooves are formed on a surface of each support and are arranged at predetermined longitudinal intervals. Each taper sleeve has a projection formed on an inner surface thereof and is attached to the support such that the projection is fitted into one of the annular engagement grooves. Each taper sleeve is tapered such that a diameter of an outer profile increases from a first end toward a second end. A ring is provided at each of four corners of the shelf. The ring is tapered such that a diameter of an inner profile increases from the first end toward the second end so as to be coincident, partially or entirely, with the outer profile of the taper sleeve. The ring is fitted onto the taper sleeve, which, in turn, is fitted onto the support. The rings are fixedly attached to longitudinally opposite ends of the shelf at different levels with respect to the shelf so as to be fitted onto the corresponding taper sleeves in a vertically staggered manner, so that the laterally adjacent shelves are connected in an aligned manner while sharing the same support.

6 Claims, 12 Drawing Sheets

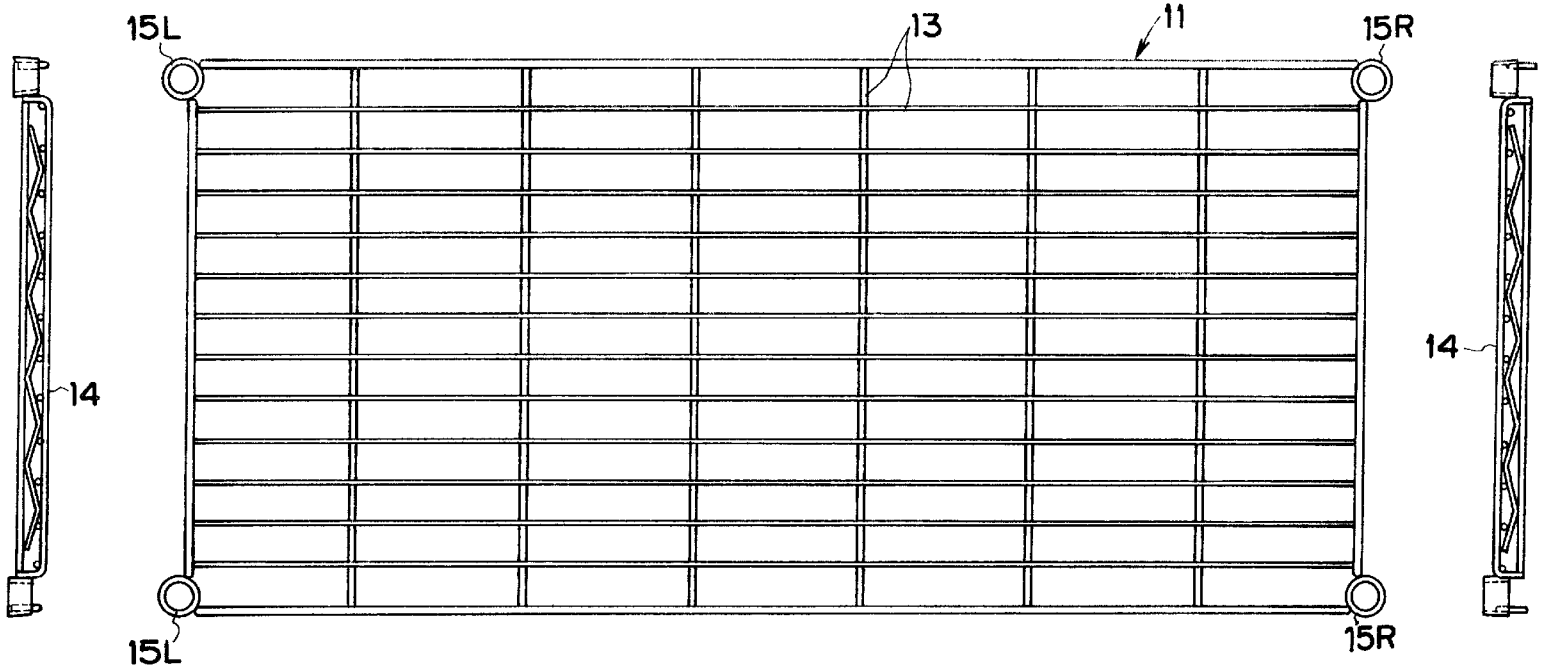
FIG.4A
FIG.4B
FIG.4C
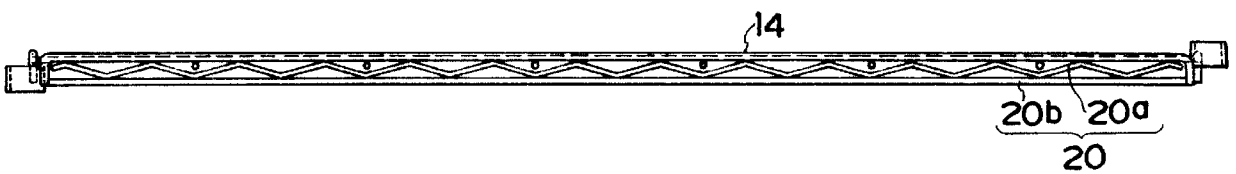
FIG.4D

14'
15'R
15'L
C
11'
13'
20'a
20'b
20

SHELF ENGAGEMENT MECHANISM

BACKGROUND OF THE INVENTION

The present invention relates to a shelf engagement mechanism for use in shelf structures used in homes, offices, warehouses, and shops, among other places.

Conventionally, a shelf structure as shown in FIG. 14 is known. The shelf structure includes a plurality of vertically arranged shelves 1 and four supports 2 for supporting the shelves 1. Such a shelf structure is disclosed in, for example, Japanese Utility Model Application Laid-Open (kokai) No. 13575/1994. As shown in FIG. 15, the shelf structure includes shelves 1, supports 2, cylindrical joints 5, and taper sleeves 6. The shelf includes wire members 3 arranged in the form of a lattice, edge members 4, and edge-member reinforcement members 10. Each edge-member reinforcement member 10 extends along the corresponding edge member 4. Longitudinally intermediate portions of each edge-member reinforcement member 10 are connected to the corresponding edge member 4. An end of each edge-member reinforcement member 10 is connected to the corresponding cylindrical joint 5, which is provided at a corner of the corresponding shelf 1. Each taper sleeve 6 is attached to the corresponding support 2. The corresponding cylindrical joint 5 is fitted onto the taper sleeve 6, whereby the support 2 supports the shelf 1 at the corresponding corner. An inner surface of each cylindrical joint 5 and an outer surface of the corresponding taper sleeve 6 are tapered such that their diameters increase along a downward direction in FIG. 15, and the cylindrical joint 5 and the taper sleeve 6 are engaged together upon assembly.

However, the above-described conventional shelf structure has the following drawback. When two of the shelf structures are to be connected together such that adjacent shelves from the respective shelf structures are to be connected laterally in an aligned manner, additional supports or special joints must be prepared. In other words, the laterally aligned shelves of the respective ones of the shelf structures cannot share the same support unless special joints are provided.

Accordingly, when the above-described conventional shelf structures are to be connected with laterally adjacent shelves aligned with each other, additional supports, poles, or special joints must be employed, involving an increase in a number of component parts. For example, when hook-type joints are employed for connecting shelf structures, the resultant shelf structure has a poor appearance and involves a drawback in that strength against lateral vibration is deteriorated.

As described above, the conventional shelf structure does not allow shelves to be laterally connected in an aligned manner while sharing the same support, without the use of special joints. Thus, when shelves are connected laterally while sharing the same support without the use of special joints, the connected shelves must be at different levels. When a shelf structure is to be connected to an existing shelf structure by use of special joints in such a manner as to share the same support and to laterally align adjacent shelves into mutual alignment, an angle that the connected shelf structures form is limited to 180° (linear connection) or 90° (perpendicular connection, as in the case of installation in a corner of a room); i.e., the angle cannot be arbitrarily selected.

When, in order to assemble the conventional shelf structure, the cylindrical joints of the shelves are fitted to the corresponding supports, top or bottom ends of the supports must be inserted through the corresponding cylindrical joints, followed by movement of the cylindrical joints to predetermined positions on the supports. When the shelves are to be removed from the supports, they must be moved up or down to the ends of the supports and be removed sequentially. Accordingly, when a shelf is to be added to the assembled shelf structure, shelves located above or below an intended installation position of the shelf must be removed from the supports.

SUMMARY OF THE INVENTION

In view of the foregoing, an object of the present invention is to provide a shelf engagement mechanism enabling shelves of separate shelf structures to be laterally connected in an aligned manner while sharing the same support without the use of special joints.

Another object of the present invention is to provide a shelf engagement mechanism enabling easy assembly or disassembly of a shelf structure, and enabling easy addition of a shelf to or removal of a shelf from an assembled shelf structure.

A further object of the present invention is to provide a shelf engagement mechanism enabling an angle of connection between an existing shelf and an additional shelf to be set freely.

To achieve the above objects, the present invention provides a shelf engagement mechanism comprising supports, taper sleeves, at least one shelf, and rings. A plurality of annular engagement grooves are formed on an outer surface of each support and are arranged at predetermined longitudinal intervals. Each taper sleeve has a projection formed on an inner surface thereof and is attached to the support such that the projection is fitted into one of the annular engagement grooves. Each taper sleeve is tapered such that a diameter of an outer profile increases from one end toward the other end. The ring is provided at each of four corners of the shelf. The rings are tapered such that the diameter of an inner profile increases from one end toward the other end so as to be coincident, partially or entirely, with the outer profile of the taper sleeve. The rings are fitted onto the taper sleeves, which, in turn, are fitted onto the supports. The rings are fixedly attached to longitudinally opposite ends of the at least one shelf at different levels with respect to the shelf so as to be fitted onto corresponding ones of the taper sleeves in a vertically staggered manner, whereby laterally adjacent shelves are connected in an aligned manner while sharing the same support.

Preferably, the ring has a closed annular cross section. Alternatively, the ring has a cutout formed therein such that a cross section of the now partial ring has a penannular shape, the shape of the letter "C." A width of the cutout is greater than the diameter of the support so that the ring can be laterally engaged with or disengaged from the support by passing the support through the cutout.

Preferably, the shelf engagement mechanism further comprises a taper cover. The taper cover is tapered such that a diameter of an inner profile thereof increases from one end toward the other end so as to be coincident, partially or entirely, with the outer profile of the taper sleeve. The taper cover is fitted onto the taper sleeve, which, in turn, is fitted onto the support.

Preferably, the taper cover has a closed annular cross section. Alternatively, the taper cover has a cutout formed therein such that the cross section has the shape of the letter "C." A width of the cutout is greater than the diameter of the support so that the taper cover can be laterally engaged with or disengaged from the support by passing the support through the cutout.

The shelf engagement mechanism according to the present invention yields the following effects.

(1) Shelf structures can be laterally connected at any angle while the laterally adjacent shelves are aligned with each other.

(2) An existing shelf structure can be easily extended in a lateral direction with no need for disassembling the shelf structure.

(3) A shelf can be easily added to an existing shelf structure, or any shelf can be easily removed from the shelf structure, with no need for disassembling the shelf structure.

(4) Laterally aligned adjacent shelves can share the same support.

(5) Appearance is improved before and after extension of a shelf structure, thereby maintaining excellence therein.

(6) Since the structure of the shelf engagement mechanism is simple, manufacturing costs can be reduced.

(7) By dividing the taper sleeve into upper and lower taper sleeves of the same profile, the rings and the taper covers can be used in common regardless of where they are used, thereby facilitating parts control.

(8) The outer walls of the rings and taper covers mentioned above in (7) assume a cylindrical shape parallel to the outer surface of the support. Therefore, no step is formed between a part located on an upper side and a part located on a lower side, so that the parts can be seen as a single unit.

BRIEF DESCRIPTION OF THE DRAWINGS

FIG. 4A is a plan view showing a shelf supported by the shelf engagement mechanism of FIG. 1;

FIG. 4B is a left-hand side view of the shelf of FIG. 4A;

FIG. 4C is a right-hand side view of the shelf of FIG. 4A;

FIG. 4D is a front view of the shelf of FIG. 4A;

DESCRIPTION OF THE PREFERRED EMBODIMENTS

Embodiments of the present invention are described below in detail with reference to the drawings.

Figure 1:
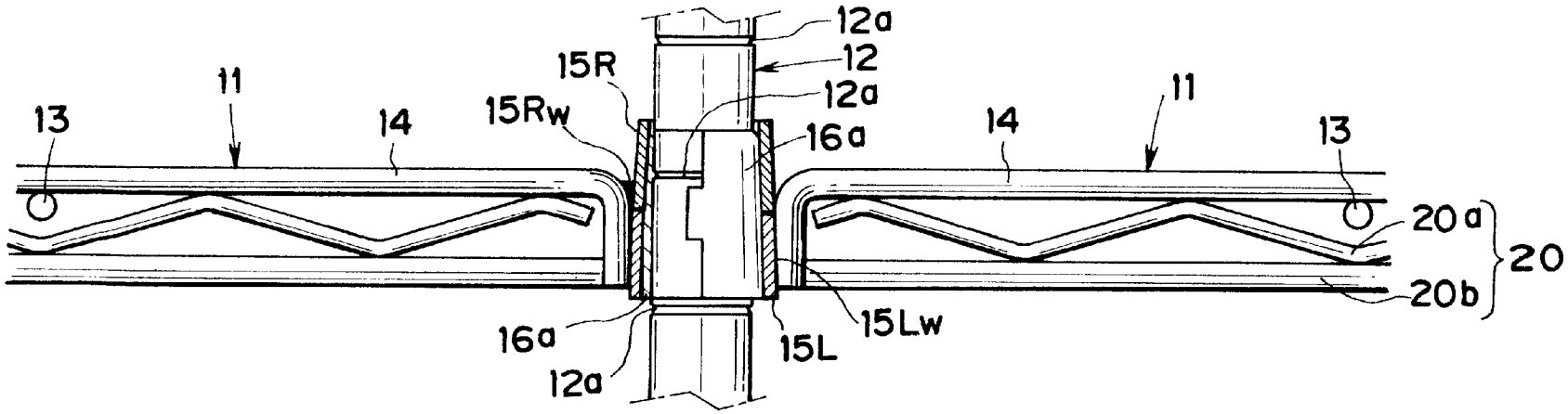
FIG. 1 is a vertical sectional view of a shelf engagement mechanism according to an embodiment of the present invention.

FIGS. 1 to 4 show a shelf engagement mechanism according to an embodiment of the present invention. A support 12 is formed of a pipe or a solid bar. A plurality of annular engagement grooves 12*a* are formed on an outer surface of the support 12 and are arranged at predetermined longitudinal intervals. A plurality of shelves 11 are attached to the support 12 at arbitrary intervals. Wire members 13 are arranged in the form of a lattice to thereby form a supporting surface the shelf 11. Rings 15L and 15R are attached to four corners of the shelf 11. A corrugated wire member 20*a* and a straight wire member 20*b* constitute an edge-member reinforcement member 20. As shown in FIG. 1, the edge-member reinforcement member 20 extends under an edge wire member 14 supporting the wire members 13. The corrugated wire member 20*a* is connected to the edge wire member 14 through, for example, welding. One end of the edge wire member 14 is fixedly attached to a lower portion of the ring 15R and another end is attached to an upper portion of the ring 15L by, for example, welding.

Figure 2:
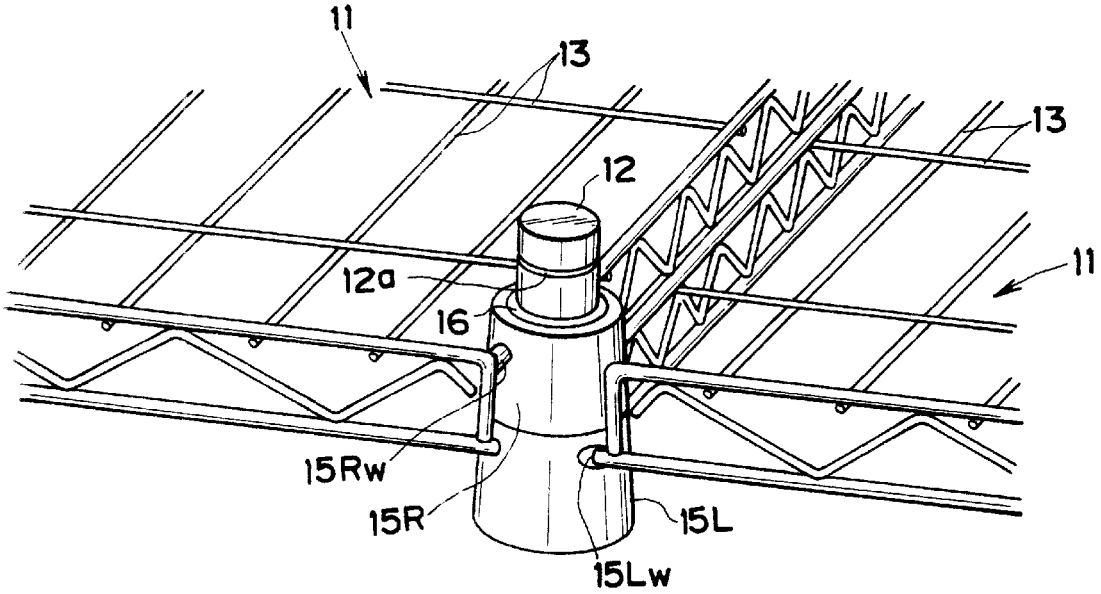
FIG. 2 is a perspective view of the shelf engagement mechanism of FIG. 1.
Figure 3:
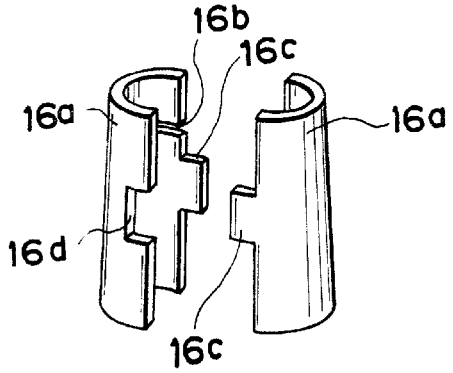
FIG. 3 is an exploded perspective view of a taper sleeve used in the shelf engagement mechanism of FIG. 1.

A taper sleeve 16 is removably attached to the support 12. The rings 15L and 15R, fixedly attached to the corners of the shelf 11, are fitted onto the corresponding taper sleeves 16, which, in turn, are attached to the corresponding supports 12, whereby the shelf 11 is attached to the supports 12. As shown in FIGS. 1 to 3, the taper sleeve 16 is attached to the outer surface of the support 12 and is composed of two sleeve pieces 16*a*.

The sleeve pieces 16*a* each have a semicylindrical shape and are attached to the support 12 in such a manner as to surround the outer surface of the support 12. As shown in FIG. 3, a wall of the sleeve piece 16*a* is tapered such that thickness thereof increases in the downward direction, so that a longitudinal cross section of the wall is wedge-shaped.

A projection 16*b* is formed on an inner surface of the sleeve piece 16*a* and is adapted to be fitted into the engagement groove 12*a* formed on the surface of the support 12. An engagement projection 16*c* and an engagement recess 16*d* are formed on corresponding mating edges of the sleeve piece 16*a* in order to effect a dovetail joint. The two sleeve pieces 16*a* are attached to the support 12 such that the engagement projections 16*c* are fitted into the corresponding engagement recesses 16*d*, while the projections 16*b* are fitted into the engagement groove 12*a*.

The outer profile of the taper sleeve 16 composed of the sleeve pieces 16*a* is tapered such that the diameter increases in the downward direction in FIG. 3, thereby assuming substantially a truncated cone shape. As shown in FIG. 1, the rings 15L and 15R fixedly attached to the corners of the shelf 11 and are fitted onto the taper sleeve 16.

In FIG. 1, the left-hand ring 15L of the shelf 11 is fixedly attached to the edge wire member 14 of the shelf 11 through, for example, welding. Specifically, an upper portion of the left-hand ring 15L and a lower portion of the left-hand end of the edge wire member 14 are fixedly attached together, thereby forming a united portion (welded portion) 15Lw.

Similarly, the right-hand ring 15R of the shelf 11 is fixedly attached to the edge wire member 14 of the shelf 11 through, for example, welding. Specifically, a lower portion of the right-hand ring 15R and an upper portion of the right-hand end of the edge wire member 14 are fixedly attached together, thereby forming a united portion (welded portion) 15Rw.

As shown in FIG. 4D, the left-hand and right-hand rings 15L and 15R, respectively, are fixedly attached to the shelf 11 at different levels. The inner profile of the ring 15L is substantially coincident with the lower half of the outer profile of the taper sleeve 16. The inner profile of the ring 15R is substantially coincident with the upper half of the outer profile of the taper sleeve 16. That is, the inner profiles of the rings 15L and 15R are tapered such that the diameter increases in the downward direction in FIG. 1.

When the left-hand and right-hand rings 15L and 15R, respectively, are fitted onto the taper sleeve 16, which is attached to the support 12, such that the ring 15R is located above the ring 15L as shown in FIG. 1, the inner surfaces of the rings 15L and 15R squeeze the taper sleeve 16. Thus, the taper sleeve 16 is pressed against the surface of the support 12 to thereby be attached securely to the support 12.

In the above-described embodiment, the rings 15L and 15R have a closed annular cross section. However, in another embodiment of the present invention shown in FIGS. 5 to 7, rings 15'L and 15'R are shaped such that the top or bottom end of a support 12 does not need to be inserted through the rings 15'L and 15'R for attachment of the rings 15'L and 15'R to the support 12. Specifically, the rings 15'L and 15'R each have a cut formed therein such that the cross section has the shape of the letter "C." The width of the cut is greater than the diameter of the support 12, so that the rings 15'L and 15'R can be laterally engaged with or disengaged from the support 12.

Figure 5:
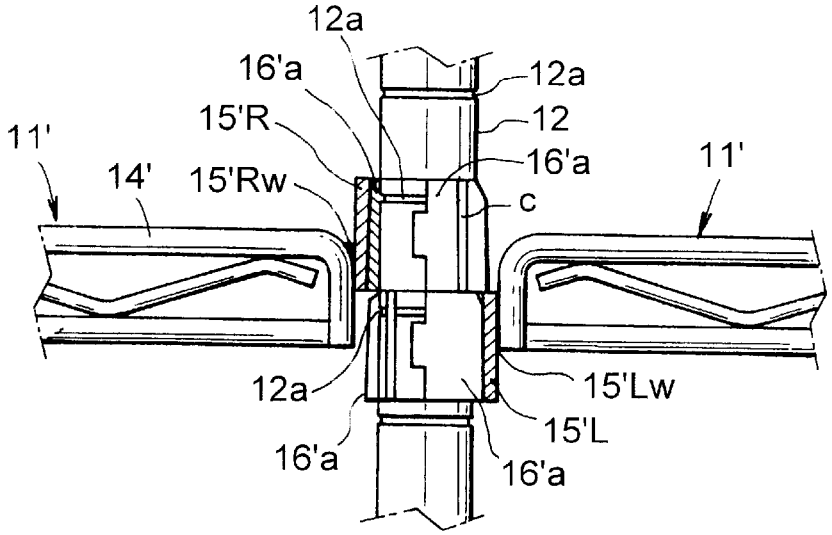
FIG. 5 is a vertical sectional view of a shelf engagement mechanism according to another embodiment of the present invention.
Figure 6:
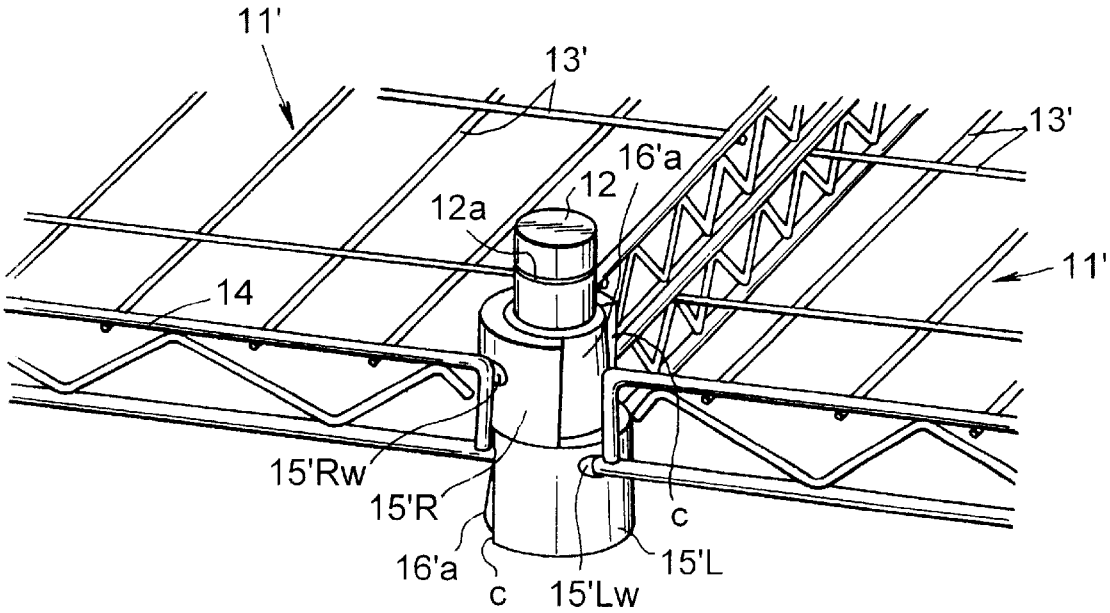
FIG. 6 is a perspective view of the shelf engagement mechanism of FIG. 5.

The present embodiment may use the taper sleeve 16 of the previously-described embodiment. However, as shown in FIG. 5, the present embodiment uses two taper sleeves 16' (accordingly, four sleeve pieces 16'*a*, two of which constitute one taper sleeve 16', are employed) instead of one taper sleeve 16. The height of the taper sleeve 16' is, for example, approximately two-third that of the taper sleeve 16. The two taper sleeves 16' are attached to the support 12 such that projections thereof are fitted into adjacent engagement grooves 12*a* formed in the support 12.

The outer profile of the taper sleeve 16' composed of the sleeve pieces 16*a*' is tapered such that the diameter increases in the downward direction in FIG. 5, thereby assuming substantially a truncated cone shape. The two taper sleeves 16' are attached to the support 12 in a vertically adjacent manner.

As shown in FIG. 5, the rings 15'L and 15'R fixedly attached to the corners of a shelf 11' are fitted onto the taper sleeve 16'.

In FIG. 5, the left-hand ring 15'L of the shelf 11' is fixedly attached to an edge wire member 14' of the shelf 11' through, for example, welding. Specifically, an upper portion of the left-hand ring 15'L and a lower portion of the left-hand end of the edge wire member 14' are fixedly attached together, thereby forming a united portion (welded portion) 15'Lw.

Similarly, the right-hand ring 15'R of the shelf 11' is fixedly attached to the edge wire member 14' of the shelf 11' through, for example, welding. Specifically, a lower portion of the right-hand ring 15'R and an upper portion of the right-hand end of the edge wire member 14' are fixedly attached together, thereby forming a united portion (welded portion) 15'Rw.

Figures 7A, 7B, 7C, 7D:
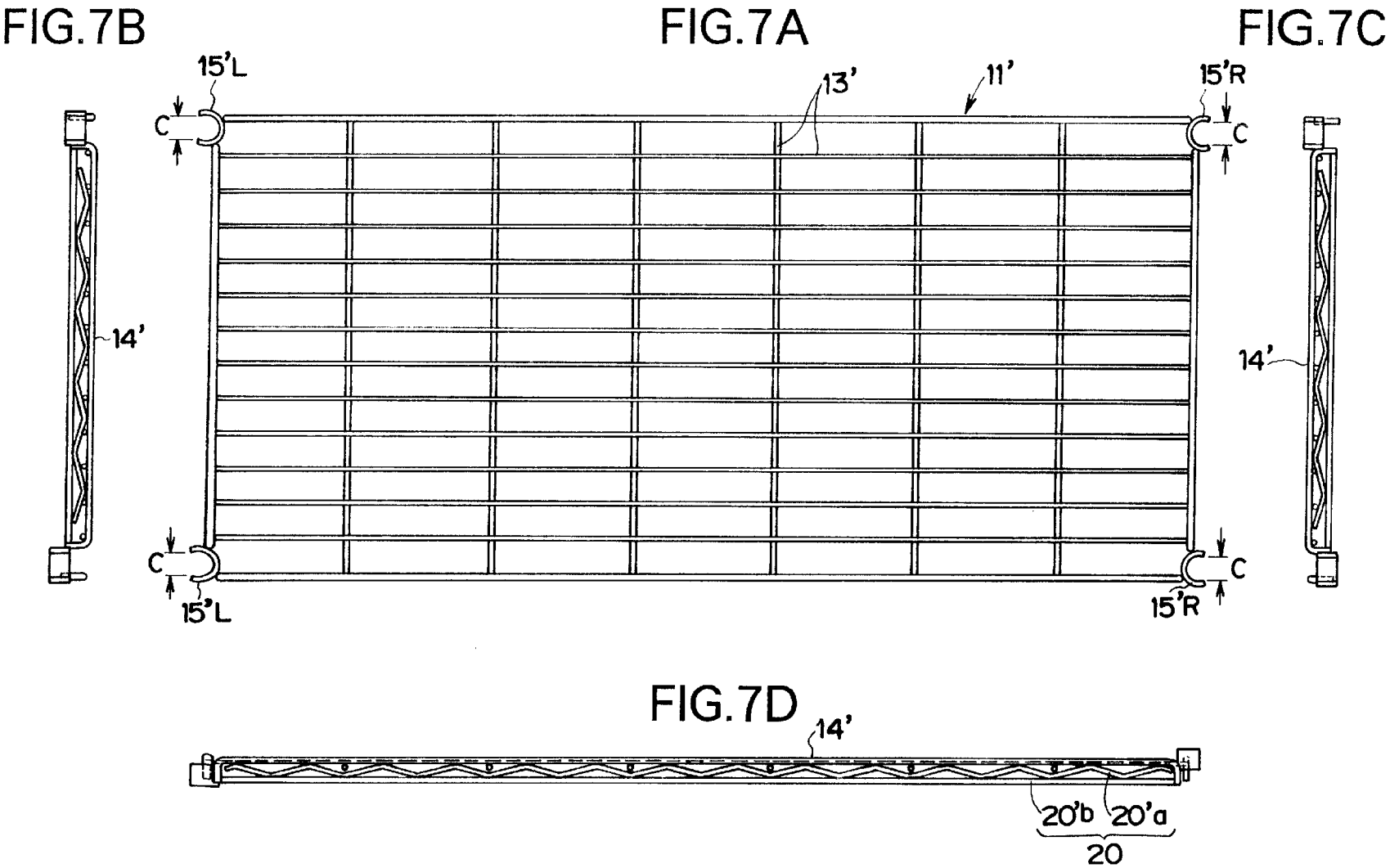
FIG. 7A is a plan view of a shelf of the shelf engagement mechanism of FIG. 5.
FIG. 7B is a left-hand side view of the shelf of FIG. 7A.
FIG. 7C is a right-hand side view of the shelf of FIG. 7A.
FIG. 7D is a front view of the shelf of FIG. 7A.

As shown in FIG. 7D, the left-hand and right-hand rings 15'L and 15'R, respectively, are fixedly attached to the shelf 11' at different levels. The inner profiles of the rings 15'L and 15'R are substantially coincident with the outer profile of the taper sleeve 16'. That is, the inner profiles of the rings 15'L and 15'R are tapered such that the diameter increases in the downward direction in FIG. 5. The outer profiles of the rings 15'L and 15'R are not tapered, but have a substantially cylindrical shape.

Figure 8:
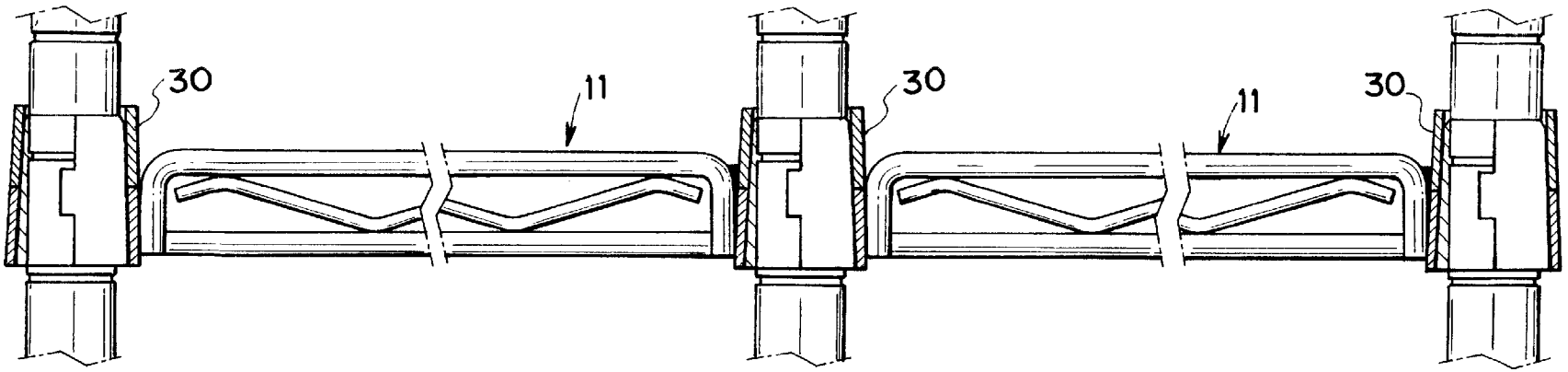
FIG. 8 is a sectional view showing two laterally connected shelves of a closed annular ring type.

Notably, when the shelves 11 are not laterally connected or when the shelves 11 are connected laterally as shown in FIG. 8, the leftmost and rightmost rings in FIG. 8 cover simply the lower half of the leftmost taper sleeve 16 and the upper half of the rightmost taper sleeve 16, respectively. As a result, the upper half and the lower half of the leftmost and rightmost taper sleeves 16, respectively, are exposed. Accordingly, two kinds of taper covers 30 are used for covering the exposed halves. The inner profile of one taper cover 30 is tapered such that the diameter increases in the downward direction in FIG. 8, whereby the taper cover 30 can be fitted onto the exposed upper half of the taper sleeve 16. The inner profile of the other taper cover 30 is tapered such that the diameter increases in the downward direction in FIG. 8, whereby the taper cover 30 can be fitted onto the exposed lower half of the taper sleeve 16.

Figure 9:
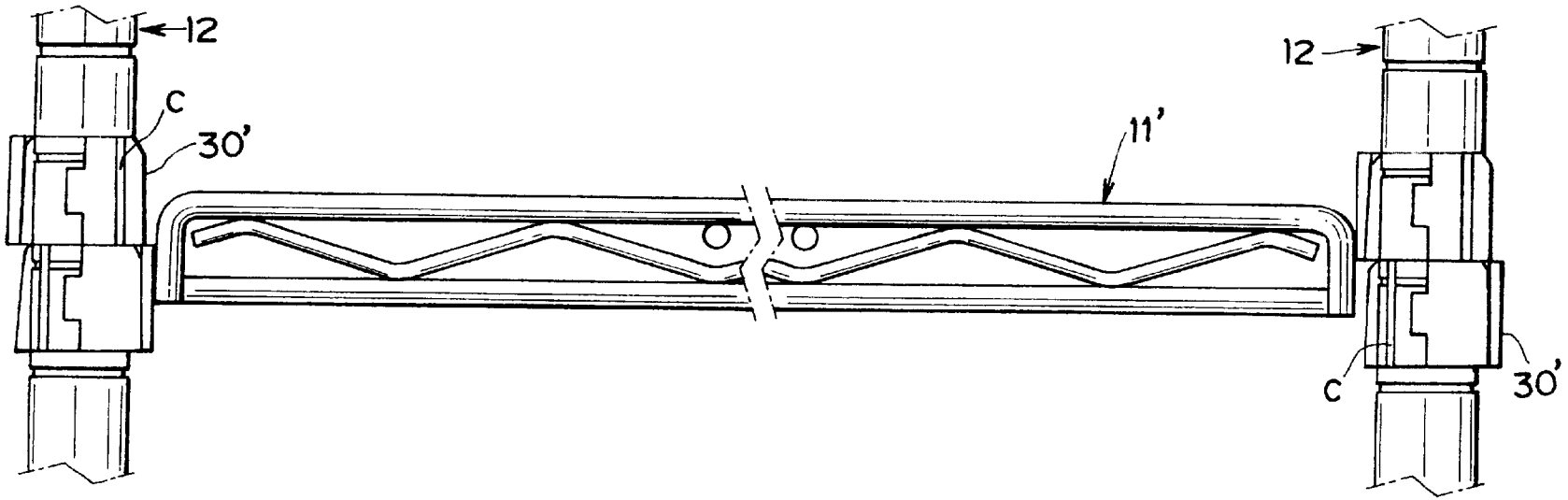
FIG. 9 is a sectional view showing a shelf of a C-shaped ring type (in the case where the shelf is not connected to another shelf)
Figure 10:
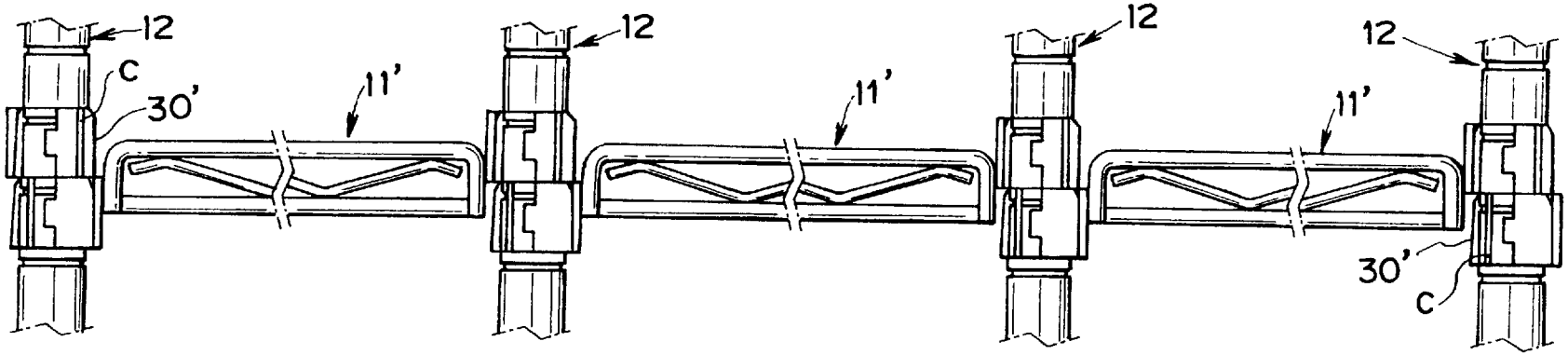
FIG. 10 is a sectional view showing three laterally connected shelves of the C-shaped ring type.
Figure 11:
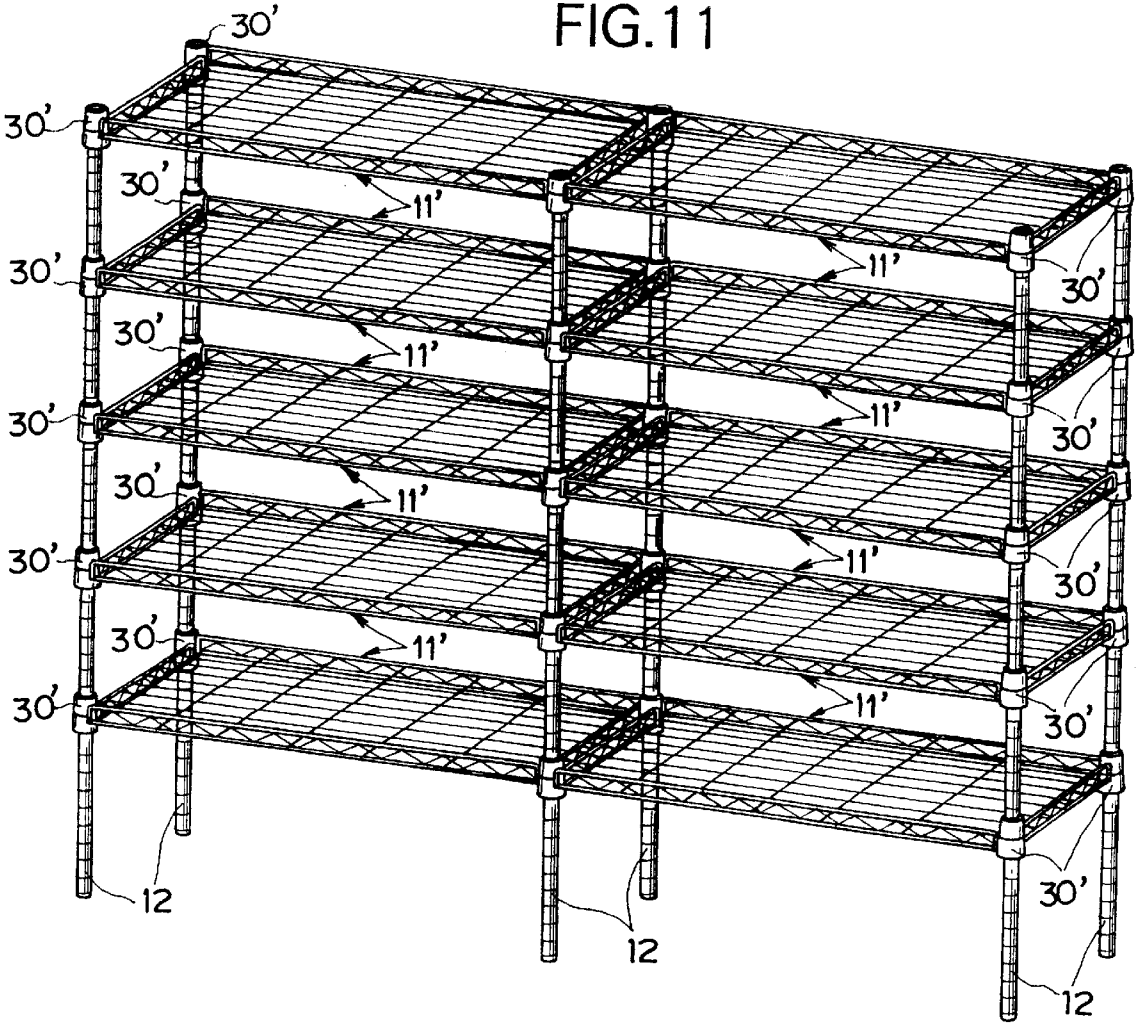
FIG. 11 is a perspective view of a laterally extended shelf structure having two columns of shelves.

In the case of the embodiment described above with reference to FIGS. 5 to 7 and using the C-type rings 15'L and 15'R, a taper cover 30' is employed as shown in FIGS. 9 and 10. The taper cover 30' has a cut c formed therein such that the cross section has the shape of the letter "C." The width of the cut c is greater than the diameter of the support 12, so that the taper cover 30' can be laterally engaged with or disengaged from the support 12. The taper cover 30' is fitted onto the exposed upper or lower taper sleeve 16'.

Next, the procedures for assembling a shelf structure, adding a shelf to an existing shelf structure, and for laterally extending an existing shelf structure will be described with reference to FIGS. 5 to 11. In this description, the shelf structure employs the C-type rings 15'L and 15'R.

A. Assembling a Shelf Structure (1) The taper sleeve 16' is attached to each of the four supports 12 at the same level.

(2) A pair of the supports 12 to which the rings 15'R of the shelf 11' are to be attached is selected. The taper covers 30' are laterally engaged with the corresponding portions of the selected supports 12 located above the corresponding taper sleeves 16'. Then, the taper covers 30' are moved in the downward direction so as to be fitted onto the respective taper sleeves 16'.

(3) While the shelf 11' is inclined, the rings 15'L are laterally engaged with the corresponding portions of the other pair of the supports 12 located above the corresponding taper sleeves 16', and the rings 15'R are laterally engaged with the corresponding portions of the pair of the supports 12 selected in step (2) and located above the corresponding taper sleeves 16'. Then, the rings 15'L and 15'R are moved in the downward direction so as to be fitted onto the respective taper sleeves 16'.

(4) The taper sleeves 16' are attached to the corresponding portions of the supports 12 located above the rings 15'L.

(5) The taper covers 30' are laterally engaged with the corresponding portions of the supports 12 located above the corresponding taper sleeves 16' attached in step (4). Then, the taper covers 30' are moved in the downward direction so as to be fitted onto the respective taper sleeves 16'.

(6) Steps (1) to (5) are repeated to complete the shelf structure.

B. Adding a Shelf to an Existing Shelf Structure (1) The taper sleeve 16' is attached to each of the four supports 12 at the same level.

(2) A pair of the supports 12 to which the rings 15'R of the shelf 11' are to be attached are selected. The taper covers 30' are laterally engaged with the corresponding portions of the selected supports 12 located above the corresponding taper sleeves 16'. Then, the taper covers 30' are moved in the downward direction so as to be fitted onto the respective taper sleeves 16'.

(3) While the shelf 11' is inclined, the rings 15'L are laterally engaged with the corresponding portions of the other pair of the supports 12 located above the corresponding taper sleeves 16', and the rings 15'R are laterally engaged with the corresponding portions of the pair of the supports 12 selected in step (2) and located above the corresponding taper sleeves 16'. Then, the rings 15'L and 15'R are moved in the downward direction so as to be fitted onto the respective taper sleeves 16'.

(4) The taper sleeves 16' are attached to the corresponding portions of the supports 12 located above the rings 15'L.

(5) The taper covers 30' are laterally engaged with the corresponding portions of the supports 12 located above the corresponding taper sleeves 16' attached in step (4). Then, the taper covers 30' are moved in the downward direction so as to be fitted onto the respective taper sleeves 16'.

(6) Steps (1) to (5) are repeated to add shelves 11' to the shelf structure completed by the procedure A described above.

C. Laterally Extending an Existing Shelf Structure (1) The upper taper covers 30' located above the shelf 11 of an existing shelf structure are moved upward and then removed from the portions of the supports 12 located above the corresponding taper sleeves 16'.

(2) Attach the taper sleeves 16' to the extension supports 12 at the same level as that of the taper sleeves 16' of the existing shelf 11'.

(3) The rings 15'L are laterally engaged with the corresponding portions of the extension supports 12 located above the corresponding taper sleeves 16', and the rings 15'R are laterally engaged with the corresponding portions of the existing supports 12 selected in step (1) and located above the corresponding taper sleeves 16'. Then, the rings 15'L and 15'R are moved in the downward direction so as to be fitted onto the respective taper sleeves 16'.

(4) The taper sleeves 16' are attached to the corresponding portions of the extension supports 12 located above the rings 15'L.

(5) The taper covers 30' are laterally engaged with the corresponding portions of the extension supports 12 located above the corresponding taper sleeves 16' attached in step (4). Then, the taper covers 30' are moved in the downward direction so as to be fitted onto the respective taper sleeves 16'.

(6) The steps (1) to (5) are repeated to complete the lateral extension of the existing shelf structure.

Figure 12:
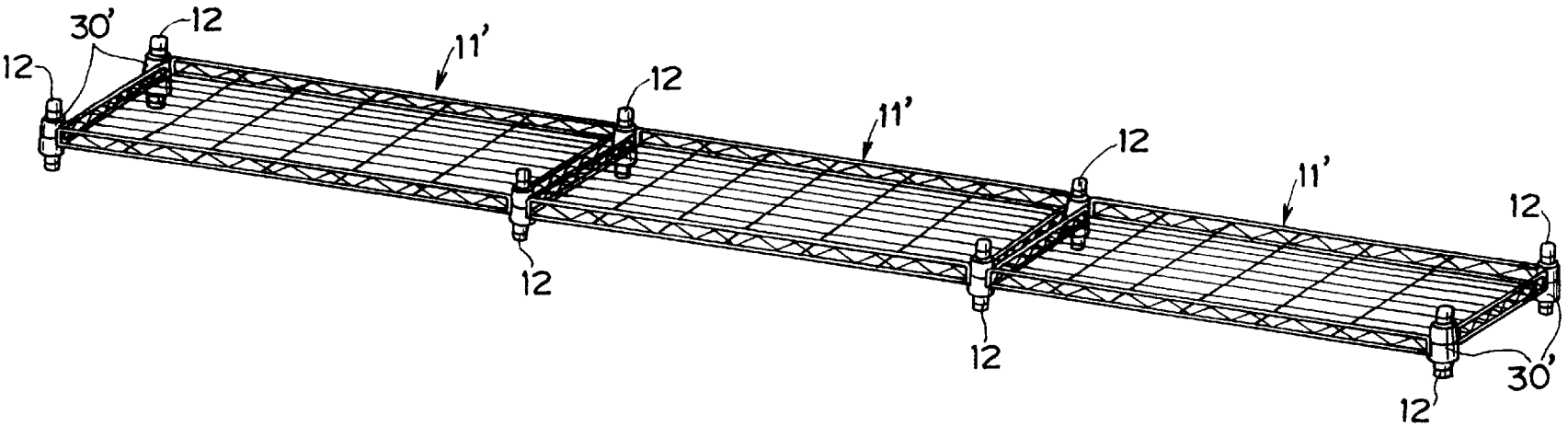
FIG. 12 is a partial perspective view of a laterally extended shelf structure having three columns of shelves.

FIG. 12 shows another example in which a shelf structure has three columns of shelves 11', which are laterally extended in the above-described manner.

Figure 13:
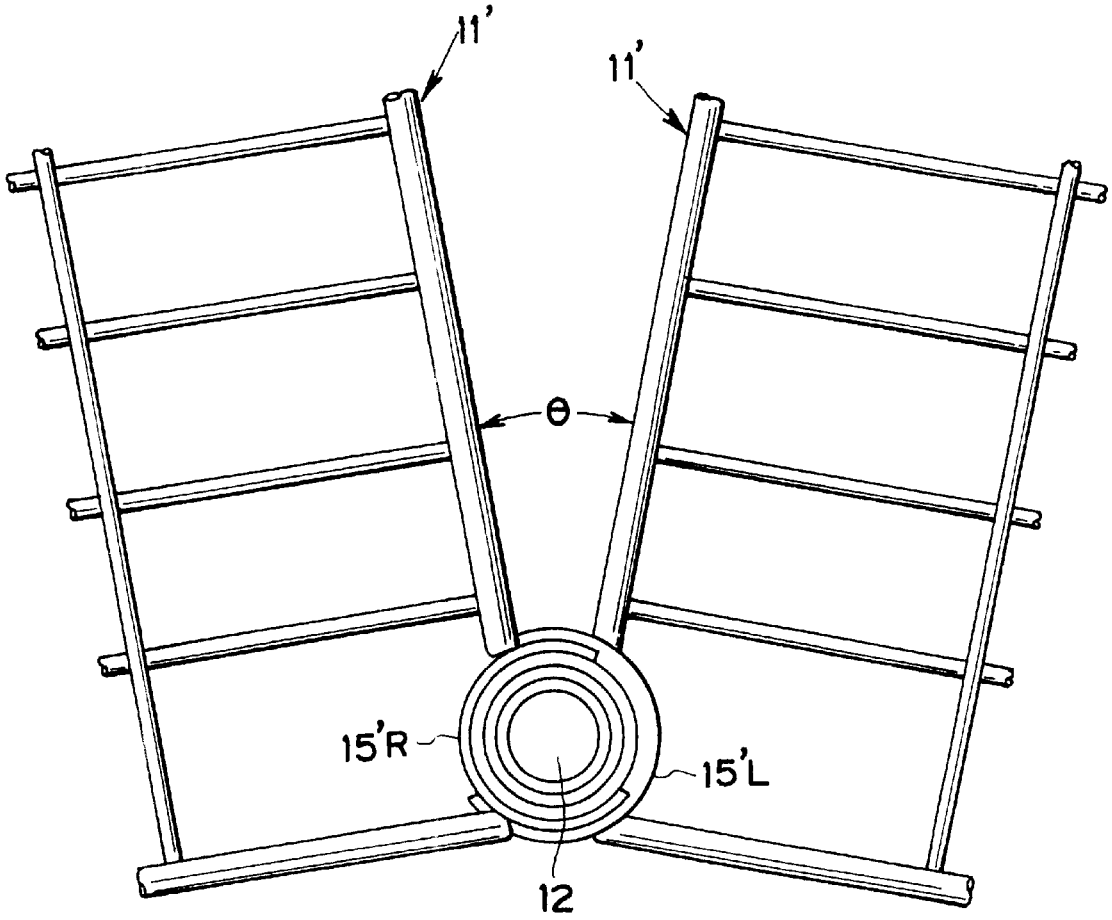
FIG. 13 is a partial plan view for explaining a freely selectable angle θ of connection of two columns of shelves.
Figure 14:
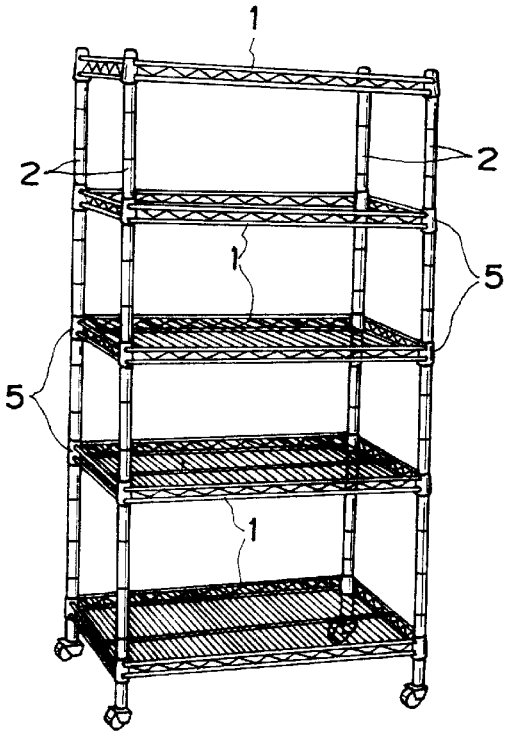
FIG.14 (PRIOR ART)
FIG. 14 is a perspective view of a conventional shelf structure.
Figure 15:
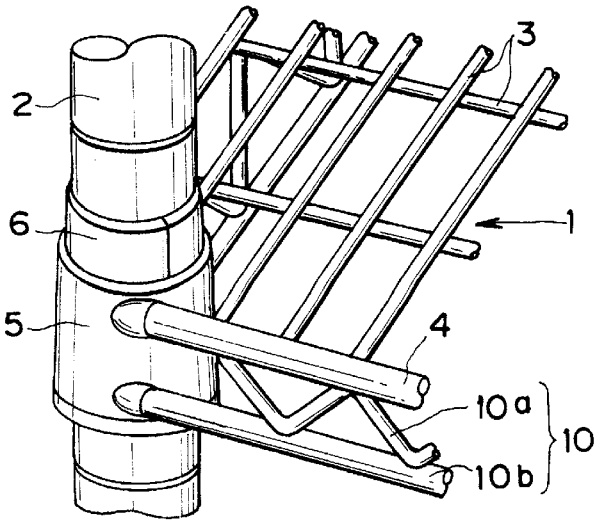
FIG.15 (PRIOR ART)
FIG. 15 is an enlarged perspective view of a conventional shelf engagement mechanism.

Further, as shown in FIG. 13, the angle θ between two adjacent shelves 11' (i.e., an existing shelf and an additional shelf) can be set freely.

What is claimed is:

1. A shelf engagement mechanism, comprising:

supports each having a plurality of annular engagement grooves formed on an outer surface, the annular engagement grooves being arranged at predetermined longitudinal intervals;

taper sleeve each having a projection formed on an inner surface, each of said taper sleeves being attached onto one of said supports such that the projection is fitted into one of the annular engagement grooves, each of said taper sleeves being tapered such that a diameter of an outer profile increases from a first end toward a second end;

a shelf; and a ring provided at each of the four corners of said shelf, said ring being tapered such that a diameter of an inner profile increases from the first end toward the second end so as to coincident, at least partially, with the outer profile of said taper sleeve, said ring being fitted onto said taper sleeve fitted onto said support, wherein said rings are fixedly attached to longitudinally opposite ends of said shelf at different levels with respect to said shelf so as to be fitted onto corresponding ones of said taper sleeves in a vertically staggered manner, whereby said shelves located laterally adjacent to each other are connected in an aligned manner while sharing the same support.

2. The shelf engagement mechanics according to claim 1, wherein said ring has a closed annular cross section.

3. The shelf engagement mechanics according to claim 1, wherein said ring has a cut formed therein such that a cross section has a penannular shape, and a width of the cut is greater than a diameter of said support, so that said ring can be laterally engaged with or disengaged from said support.

4. The shelf engagement mechanics according to claim 1, further corresponding a taper cover tapered such that a diameter of an outer profile increases from a first end toward the second end so as to coincident, at least partially, with the outer profile of said taper sleeve, said taper cover being fitted onto said taper sleeve fitted onto said support.

5. The shelf engagement mechanics according to claim 4, wherein said ring has a closed annular cross section.

6. The shelf engagement mechanics comprising:

supports each having a plurality of annular engagement grooves formed on an outer surface, the annular engagement grooves being arranged at predetermined longitudinal intervals;

taper sleeves each having a projection formed on an inner surface, each of said taper sleeves being attached onto one of said supports such that the projection is fitted into one of the annular engagement grooves, each of said taper sleeves being tapered such that a diameter of an outer profile increases from a first end toward a second end;

a shelf; and a ring provided at each of the four corners of said shelf, said ring being tapered such that a diameter of an inner profile increases from the first end toward the second end so as to coincident, at least partially, with the outer profile of said taper sleeve, said ring being fitted onto said taper sleeve fitted onto said support, a taper cover tapered such that a diameter of an inner profile increases from thr first end toward the second end so as to be coincident, at least partially, with the outer profile of said taper sleeve, said taper cover being fitted onto said taper sleeve fitted onto said support;

wherein said rings are fixedly attached to longitudinally opposite ends of said shelf at different levels with respect to said shelf so as to be fitted onto corresponding ones of said taper sleeves in a vertically staggered manner, whereby said shelves located laterally adjacent to each other are connected in an aligned manner while sharing the same support, and said taper cover has a cut formed therein such that a cross section has a penannular shape, and a width of the cut is greater than a diameter of said support, so that said ring can be laterally engaged with or disengaged from said support.

* * * * *